US010919657B2

(12) United States Patent
Brandhorst et al.

(10) Patent No.: US 10,919,657 B2
(45) Date of Patent: Feb. 16, 2021

(54) METHOD OF, AND APPARATUS FOR, FEEDING PRODUCTS INTO CONTAINERS

(71) Applicant: Focke & Co. (GmbH & Co. KG), Verden (DE)

(72) Inventors: Björn Brandhorst, Hörstel (DE); Wolfgang Pradel, Bersenbrück (DE); Marco Schloermann, Neukamperfehn (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 347 days.

(21) Appl. No.: 15/578,035

(22) PCT Filed: May 17, 2016

(86) PCT No.: PCT/EP2016/000806

§ 371 (c)(1),
(2) Date: Nov. 29, 2017

(87) PCT Pub. No.: WO2016/193835

PCT Pub. Date: Dec. 8, 2016

(65) Prior Publication Data

US 2018/0162573 A1 Jun. 14, 2018

(30) Foreign Application Priority Data

Jun. 5, 2015 (DE) ..... 10 2015 108 895

(51) Int. Cl.
*B65B 35/54* (2006.01)
*B65B 43/56* (2006.01)
(Continued)

(52) U.S. Cl.
CPC ..... *B65B 35/54* (2013.01); *B65B 5/10* (2013.01); *B65B 5/106* (2013.01); *B65B 35/405* (2013.01); *B65B 43/56* (2013.01)

(58) Field of Classification Search
CPC ..... B65B 35/54; B65B 35/405; B65B 35/24; B65B 35/44; B65B 65/003;
(Continued)

(56) References Cited

U.S. PATENT DOCUMENTS 3,397,504 A * 8/1968 Drennan ..... B65B 21/18 53/448
3,615,001 A * 10/1971 Temple ..... B65B 35/50 198/444
(Continued)

FOREIGN PATENT DOCUMENTS

DE 3736610 A1 5/1989
DE 102009003845 A1 11/2010
(Continued)

OTHER PUBLICATIONS

Deutsches Patent—Und Markenamt (German Patent and Trademark Office), Recherchebericht (search in connection with related application), Feb. 11, 2016.
(Continued)

*Primary Examiner* — Dariush Seif
(74) *Attorney, Agent, or Firm* — Laurence P. Colton; Smith Tempel Blaha LLC

(57) ABSTRACT

A method of feeding products into containers, in particular of feeding bags into cartons, wherein at least two different types of products are fed into a container, wherein the products are transported via respective feeding devices, in particular conveyors, in the direction of a device for feeding the products into a container, wherein each type of the products is transported separately by means of a dedicated feeding device, and wherein the conveying speed of the feeding devices is controlled such that, following the feed-
(Continued)

ing devices, the products are present in a sequence which corresponds to the arrangement of the products within the container.

9 Claims, 10 Drawing Sheets

(51) Int. Cl.
*B65B 5/10* (2006.01)
*B65B 35/40* (2006.01)

(58) Field of Classification Search
CPC ..... B65B 2220/14; B65B 5/10; B65B 5/106; B65B 5/064; B65B 43/56; B65G 47/31; B65G 47/084; B65G 47/71; B65G 47/72
USPC ..... 53/443, 154, 531, 237, 259; 198/445, 198/447, 461.1, 419.2
See application file for complete search history.

(56) References Cited

U.S. PATENT DOCUMENTS 4,215,774 A * 8/1980 Manservisi ..... B65B 35/54 198/444
4,673,078 A * 6/1987 Swiatlowski ..... B65G 47/681 198/418.2
5,379,575 A * 1/1995 Focke ..... B65B 5/06 53/246
5,553,442 A * 9/1996 Fadaie ..... B65B 25/146 414/404
5,667,055 A * 9/1997 Gambetti ..... B65B 21/06 198/418.7
5,778,640 A * 7/1998 Prakken ..... B65B 5/061 53/244
7,233,840 B2 * 6/2007 Schiesser ..... B65G 15/22 198/395
8,612,050 B2 * 12/2013 Lee ..... B65B 35/44 198/411
9,193,524 B2 * 11/2015 Gue ..... B65G 1/1378
2003/0183481 A1 * 10/2003 Hoeg ..... A23G 7/0037 198/348
2004/0098948 A1 * 5/2004 Caporali ..... B07C 3/008 53/443
2005/0022481 A1 * 2/2005 Ballestrazzi ..... B65B 25/14 53/553
2005/0241910 A1 * 11/2005 Affaticati ..... B07C 5/36 198/357
2007/0261368 A1 * 11/2007 Krahl ..... B65G 25/02 53/244
2009/0191044 A1 * 7/2009 Duchemin ..... B65G 47/29 414/806
2010/0030373 A1 * 2/2010 Lee ..... B65B 35/44 700/223
2011/0005174 A1 * 1/2011 Prahm ..... B65B 5/061 53/473
2014/0157732 A1 * 6/2014 Gasber ..... B65B 25/008 53/473
2016/0096694 A1 * 4/2016 Baylor ..... B65B 5/06 414/774
2016/0185533 A1 * 6/2016 Lykkegaard ..... B65G 47/52 198/890.1
2016/0297615 A1 * 10/2016 Franzaroli ..... B65G 15/50
2020/0017244 A1 * 1/2020 Loekoes ..... B65B 35/32

FOREIGN PATENT DOCUMENTS

DE 102009015618 A1 11/2010
EP 2246277 A2 11/2010
EP 2631185 A1 8/2013
JP 2007161315 A 6/2007

OTHER PUBLICATIONS

WIPO, International Search Report, dated Aug. 2, 2016.

* cited by examiner

METHOD OF, AND APPARATUS FOR, FEEDING PRODUCTS INTO CONTAINERS

STATEMENT OF RELATED APPLICATIONS

The application is the US PCT National Phase of International Application No. PCT/EP2016/000806 having an International Filing Date of 17 May 2016, which claims priority on German Patent Application No. 10 2015 108 895.9 having a filing date of 5 Jun. 2015.

BACKGROUND OF THE INVENTION

Technical Field

The invention relates to a method of feeding products into containers, in particular of feeding bags into cartons, wherein at least two different types of products are fed into a container.

The invention also relates to a corresponding apparatus for feeding products into containers. in particular for feeding bags into cartons, wherein at least two different types of products are fed into a container.

Prior Art

It is frequently necessary in practice for different products to be introduced into a joint container and packaged in this way. The different products may be, for example, bags with different contents. It is also conceivable for the contents to be the same, but for the quantities to be different. Of course, a combination of both is also possible. In addition, the design and/or the presentation of the bags can also differ from one another. The different products therefore differ from one another in respect of at least one parameter.

It is a problem with known packaging machines that the different products have to be present in the requisite number in order to be introduced into the container. However, this is difficult at least when the operation of feeding the products is subject to certain fluctuations, for example problems with the products and/or fluctuations in the product feed. This usually renders necessary the provision of costly product stores, or disadvantageous interruptions in the packaging process are required.

BRIEF SUMMARY OF THE INVENTION

Proceeding from this, it is an object of the invention to develop methods and apparatuses of the type mentioned in the introduction further, in particular in respect of feeding the products to the container in as cost-effective manner as possible and as far as possible without interruptions.

A method for solving this object is a method of feeding products into containers, in particular of feeding bags into cartons, wherein at least two different types of products are fed into a container, characterized in that the products are transported via respective feeding devices in particular conveyors, in the direction of a device for feeding the products into a container, wherein each type of the products is transported separately by means of a dedicated feeding device, and wherein the conveying speed of the feeding devices is controlled such that, following the feeding devices, the products are present in a sequence which corresponds to the arrangement of the products within the container. Accordingly, provision is made for the products to be transported via respective feeding devices, in particular conveyors, in the direction of a device for feeding the products into a container, wherein each type of the products is transported separately by means of a dedicated feeding device, and wherein the conveying speed of the feeding devices is controlled such that, following the feeding devices, the products are present in a sequence which corresponds to the arrangement of the products within the container.

By virtue of adapting or controlling the conveying speed of the feed conveyors, which convey separate types of product, it is possible to compensate for fluctuations in the product feed. This makes it possible to dispense with a store for the products. In addition, following the feeding devices, the products are present in the necessary order or sorted arrangement.

In a preferred configuration of the method according to the invention, provision is made for the feeding devices to feed the products to a removal conveyor, wherein the products are transferred, preferably by means of at least one pusher, from the individual feeding devices to the removal conveyor, specifically in accordance with the sequence of the products in the container.

In a preferred embodiment, provision may be made for the feeding devices to be designed in the form of conveyor belts, on which the products are transported, wherein the conveying speed of the conveyor belts can be influenced by a control means such that the products reach the removal conveyor in a sequence which corresponds to the sequence of the products in the container.

A special feature can reside in the fact that each feeding device is formed from a plurality of conveyors following one after the other in the conveying direction of the products, wherein the conveying speed of the individual conveyor belts is controlled individually in order to achieve the desired order of the products on the removal conveyor.

It is advantageous if the products are pushed off from the respectively final conveyor belts of the feeding devices onto the removal conveyor, which is arranged at an essentially equal height level, wherein the removal conveyor is directed transversely to the feeding devices and correspondingly transports the products away in the direction of the device for feeding the products into the container. This solution has, in particular, the advantage that there is no need for the products to be raised or deposited or dropped, and this reduces the risk of damage to the products.

In a preferred embodiment, provision is made for the removal conveyor to be formed from a plurality of adjoining conveyor belts, on which the products are transported, wherein the conveying speed of at least one conveyor belt can be influenced by the control means such that groups of products are formed, wherein the distances formed between the groups in the conveying direction are different, in particular greater, than those between the products of a group, and wherein the products of a group form preferably a layer of products within the container.

This solution has, in particular, the advantage that the formation of spaced-apart groups makes it possible for the products to be pushed off into the container without the conveying operation being interrupted.

An alternative development can provide for the products to be fed into the carton (directly or without transversely directed removal conveyors) by the feeding devices, wherein the feeding devices, at least in part, are of pivotable design in order to set down the products at an appropriate location in the carton.

An apparatus for achieving the object mentioned in the introduction is an apparatus for feeding products into containers, in particular for feeding bags into cartons, wherein at least two different types of products are fed into a container, characterized by feeding devices for a respective type of products, for transporting the same in the direction of a device for feeding the products into a container, wherein the conveying speed of the feeding devices can be controlled by a control means such that, following the feeding devices, the products are present in a sequence which corresponds to the arrangement of the products within the container. Accordingly, provision is made for feeding devices to be provided for a respective type of products, for transporting the same in the direction of a device for feeding the products into a container, wherein the conveying speed of the feeding devices can be controlled by a control means such that, following the feeding devices, the products are present in a sequence which corresponds to the arrangement of the products within the container.

The feeding devices are preferably followed by a removal conveyor which can be fed the products by the feeding devices, wherein the products are arranged on the removal conveyor in accordance with the sequence of the products in the container.

In a preferred embodiment, provision is made for the feeding devices to be designed in the form of conveyor belts, on which the products are transported, wherein the conveying speed of the conveyor belts can be influenced by a control means such that the products reach the removal conveyor in the sequence which corresponds to the sequence of the products in the container.

A special feature can reside in the fact that each feeding device is formed from a plurality of conveyor belts following one after the other in the conveying direction of the products, wherein the conveying speed of the individual conveyor belts can be controlled individually in order to achieve the desired order of the products on the removal conveyor.

Provision is preferably made for at least the respectively final conveyor belts of the feeding devices and the removal conveyor to be arranged at an essentially equal height level and therefore the products can be pushed off from the conveyor belts onto the removal conveyor, wherein the removal conveyor is directed transversely to the feeding devices and transports the products in the direction of the device for feeding the products into the container.

A further special feature can reside in the fact that the removal conveyor is formed from a plurality of adjoining conveyor belts, on which the products are transported, wherein the conveying speed of at least one conveyor belt can be influenced by the control means such that groups of products can be formed, wherein the distances formed between the groups in the conveying direction are different, in particular greater, than those between the products of a group, and wherein the products of a group form preferably a layer of products within the container.

According to an alternative development, provision may be made for the feeding devices, at least in part, to be of pivotal design in order to set down the products directly in the container at an appropriate position.

In this case, provision may also be made for the feeding devices to be designed in the form of endless conveyors for transferring the products into the container, wherein the products are retained and transported between conveying strands of the endless conveyors, and wherein the planes formed by the conveying strands are twisted, preferably jointly, in the transporting direction in order to feed the product to the container in accordance with the position in the latter.

Provision is preferably also made for the feeding devices to be designed such that they can be pivoted and/or driven independently of one another.

BRIEF DESCRIPTION OF THE DRAWINGS

The invention will be explained hereinbelow with reference to two preferred exemplary embodiments shown in the drawing, in which.

DETAILED DESCRIPTION OF PREFERRED EMBODIMENTS

The invention will be described hereinbelow with reference to apparatuses for feeding bags 10 into cartons 11. Products other than bags 10 can also be fed, in the same way that containers other than cartons 11 come into the equation. Accordingly, the terms "bags" and "cartons" are used to represent all the conceivable products and containers.

Figure 1:
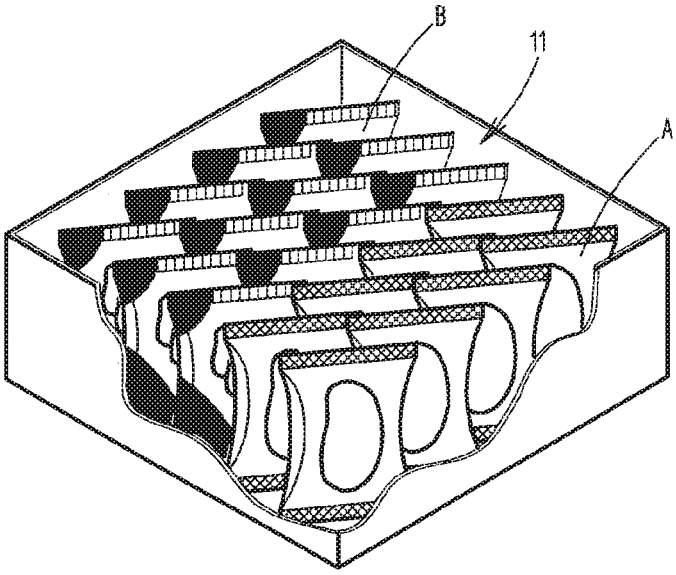
FIG. 1 shows a schematic, three-dimensional illustration of a first container with different products.
Figure 2:
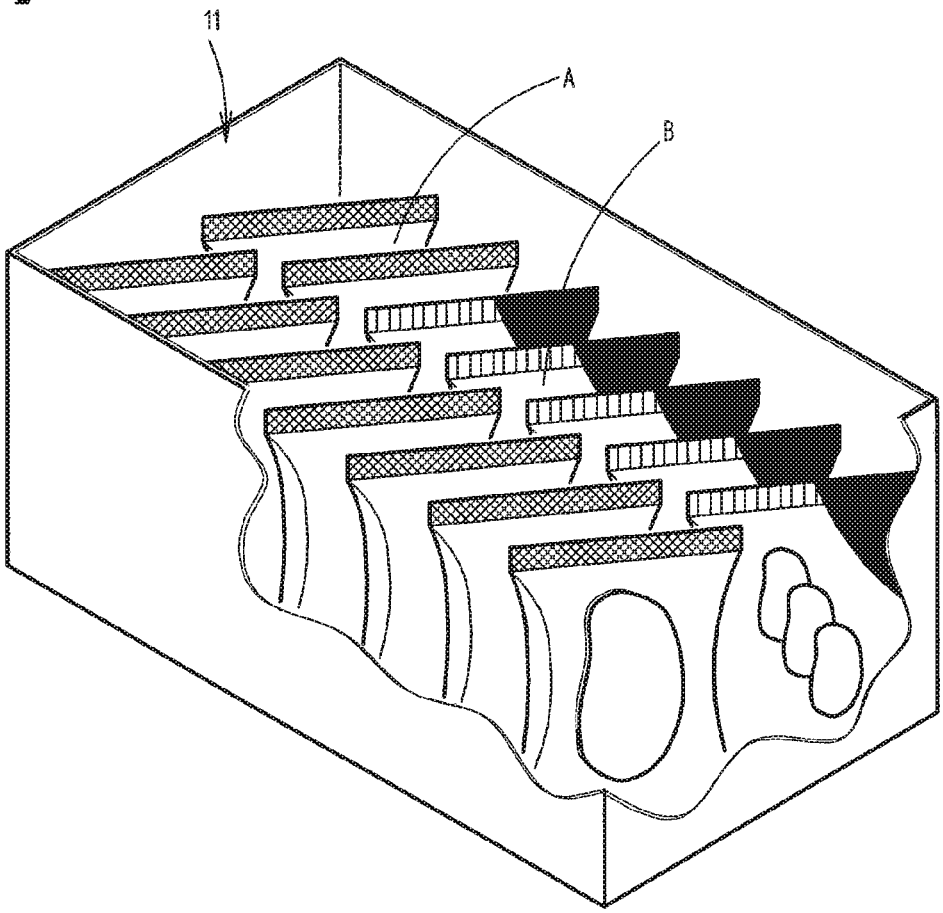
FIG. 2 shows a second container in an illustration according to FIG. 1.

The invention is concerned with feeding two different types of products A, B into the cartons 11. FIGS. 1 and 2 show two examples of formations of the products A, B in examples of cartons 11.

The products A, B can differ in respect of contents, size, presentation or in respect of other features of the contents or packaging. It is, of course, also conceivable for the products A, B to differ in respect of a number of factors.

Whereas FIG. 1 shows the products A, B in each case arranged separately in rows, FIG. 2 shows a formation of the products A, B in which the products are in a mixed arrangement at least in some of the rows. It is also conceivable for the products A, B to be arranged in a number of layers one above the other.

Figure 3:
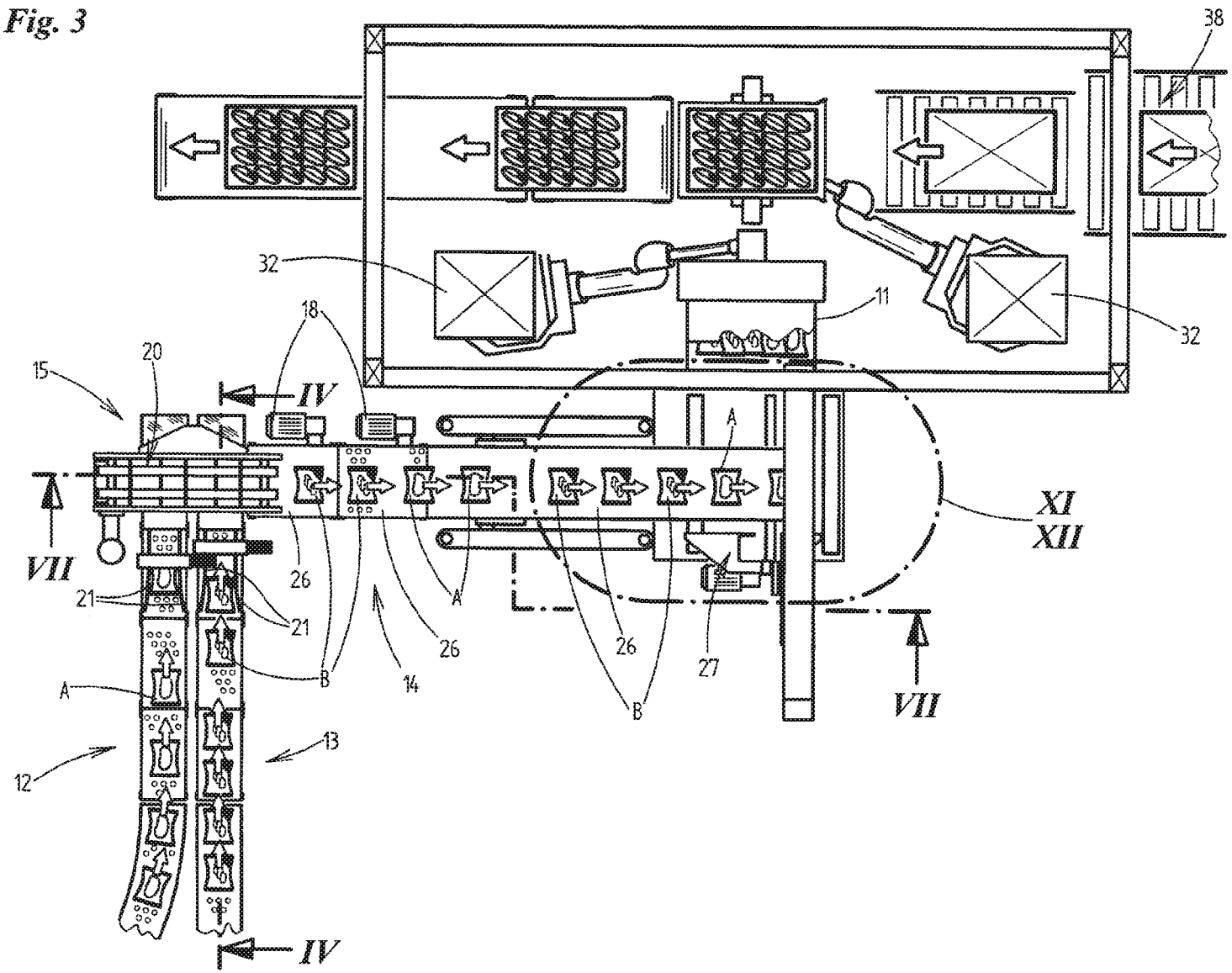
FIG. 3 shows a plan view of a first variant of an apparatus for feeding products into containers.

FIG. 3 shows an overview of a first apparatus for feeding bags 10 into cartons 11. The bags 10 are fed separately by two feeding devices 12, 13, wherein in the present case products A are transported by the feeding device 12 and products B are transported by the feeding device 13.

The products A, B or bags 10 are transported by the feeding devices 12, 13 in the direction of a removal conveyor 14, which in this case is directed transversely, and transferred to the same. For this purpose, a transfer station 15 is provided in the crossover region of the feeding devices 12, 13 and of the removal conveyor 14.

Figure 4:
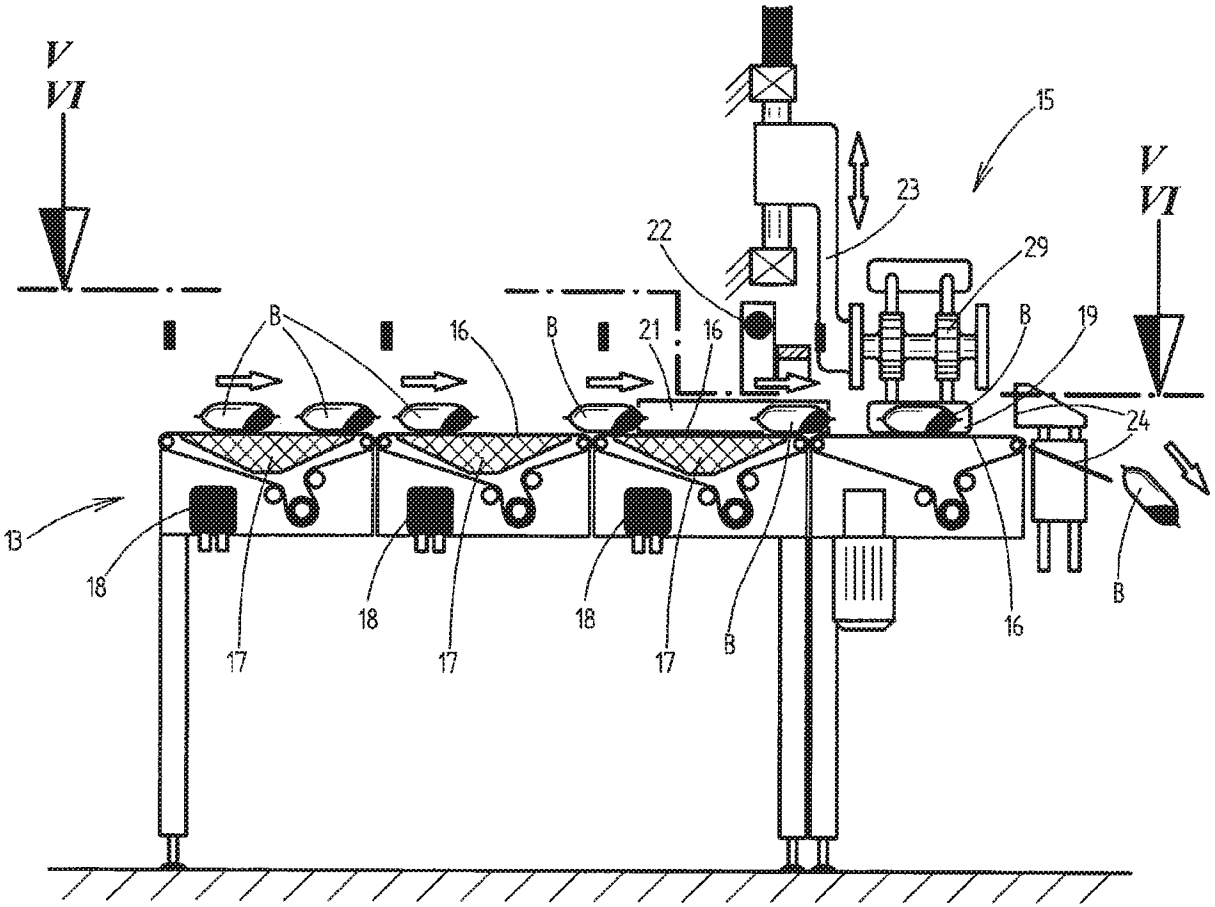
FIG. 4 shows a vertical section through the apparatus according to FIG. 3, taken along section line IV-IV in FIG. 3, FIGS. 5 and 6 show a plan view of the apparatus, in accordance with arrow V and VI, respectively, in FIG. 4, during successive phases of the operation of transporting the products.

As FIG. 4 shows, the bags 10 or products A, B are transported in a state in which they lie (flat) on the feeding devices 12, 13.

The feeding devices 12, 13 are formed by a plurality of successive, adjoining conveyor belts 16, on which the products A, B or bags 10 lie flat. In the present case, three conveyor belts 16 are arranged one after the other, it also being possible, of course, for the number of conveyor belts 16 to be greater or smaller than this. During transportation, the bags 10 are retained on the conveyor belts 16 by negative pressure. For this purpose, each of the conveyor belts 16 has located beneath it a vacuum chamber 17, with the aid of which the bags 10 can be subjected to negative pressure and thus retained on the conveyor belts 16.

Each conveyor belt 16 can be driven individually by a servomotor 18. The servomotors 18 are controlled by a control means (not shown). The control means makes it possible for the conveying speed of the individual conveyor belts 16 to be regulated individually via the servomotors 18.

Following the three conveyor belts 16 of the feeding device 12, the transfer station 15 contains a further conveyor belt 16, albeit one without a vacuum chamber 17. Above the conveyor belt 16 is the operating region of a pusher 19, by means of which the bags 10 are pushed off transversely onto the removal conveyor 14. In the present case, the pusher 19 is arranged in the form of a driver on an (endless) conveyor 20, which is arranged above the conveyor 16. It is possible, as shown, for a plurality of pushers 19 to be provided on the conveyor 20, each pusher pushing off a respective product A, B.

A special feature resides in the fact that the feeding devices 12, 13 and the removal conveyor 14, or the conveyor belts 16 and the removal conveyor 14, are arranged at an essentially equal height level, and therefore the bags 10 can be pushed off at the same height level. It is therefore not necessary for the bags 10 to be gripped and deposited, and therefore the operation of transporting the bags 10 is a particularly careful one.

In order for it to be possible for the apparatus to be adapted to different bags 10 or different products A, B, funnel-like guide plates 21 are provided in the region of the feeding devices 12, 13, it being possible for said guide plates to center the position of the bags 10 in the conveying direction or in the longitudinal direction of the conveyor belts 16. The distance between the guide plates 21 can be adapted in each case by an adjustment motor 22, so that it is possible to process products A, B for example of different widths.

It is also the case that the conveyor 20 with its driver-like pushers 19 is of adjustable design. For this purpose, the conveyor 20 is arranged on a carrying arm 23, which is mounted in a height-adjustable manner. This makes it possible for the apparatus to be adapted to products A, B of different heights or thicknesses.

Furthermore, a height-adjustable stop 24 is arranged at the end of the conveyor belts 16. Products A, B can be ejected as required, as shown schematically in FIG. 4, by being lowered, raised or displaced in some other way.

The apparatus described thus far operates as follows:

In order for it to be possible to fill a container in the manner shown in FIG. 1, three products B and two products A are required in each row or layer. For this purpose, the feeding devices 12, 13, or the conveyor belts 16 thereof, are controlled such that the products A, B reach the final conveyor belt 16 in the appropriate sequence and are pushed off there by the conveyor 20, or the pushers 19 thereof, onto the removal conveyor 14.

In the present case, accordingly, the feeding device 13 is operated such that first of all three products B, and then two products A, pass to the removal conveyor 14. This means that it is usually the case that the feeding device 12 is operated more slowly than the feeding device 13 during the operation of feeding the products B.

Figure 5:
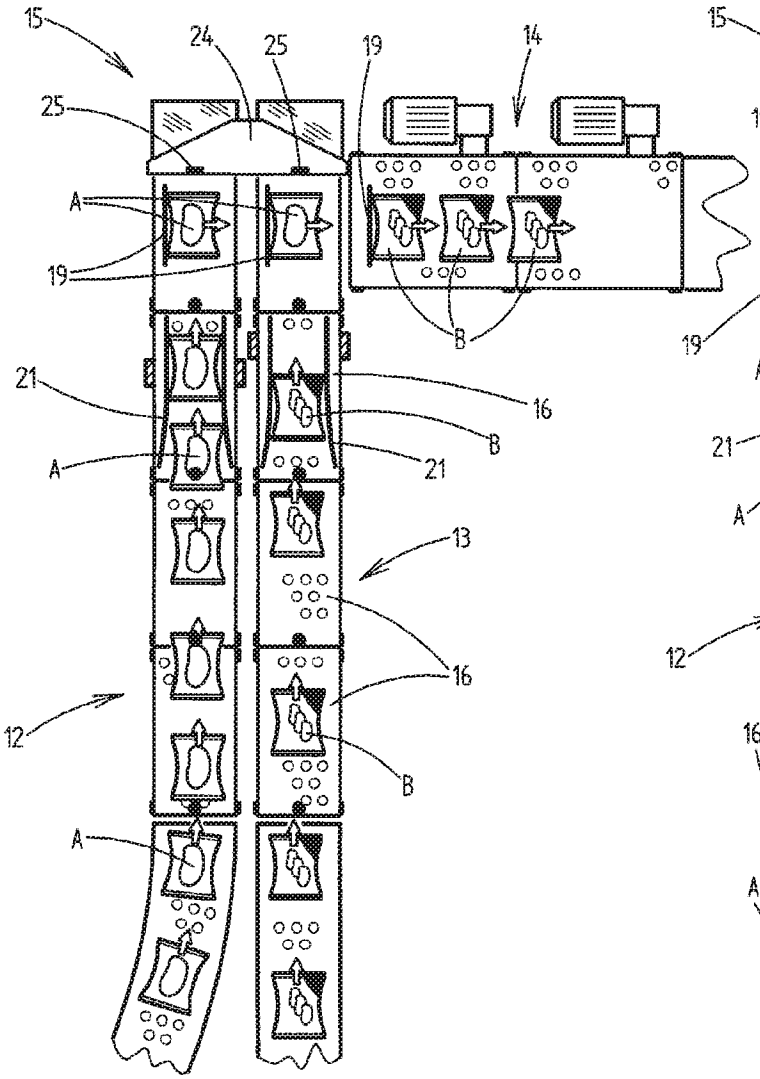

In addition, FIG. 5 shows that it is possible for, in this case for example, the products B not to be fed in a sufficient quantity, which can be seen from the large distances between the products B. Normally, in such a situation, the installation would have to be stopped until a sufficient quantity of products B is available again. In the present case, however, the operation of feeding the products A can be slowed down and, at the same time, the speed of the conveyor belts 16 of the feeding device 13 can be accelerated in order to make products B available in good time, this maintaining the sequence of the products A, B on the removal conveyor 14.

If it is not possible to make a sufficient quantity of products B available in good time, it is also conceivable for "excess" products A to be ejected at the end of the feeding device 12, the stop 24 being pivoted away as shown in FIG. 4. The products A ejected in this way can be fed anew to the feeding device 12.

Figure 6:
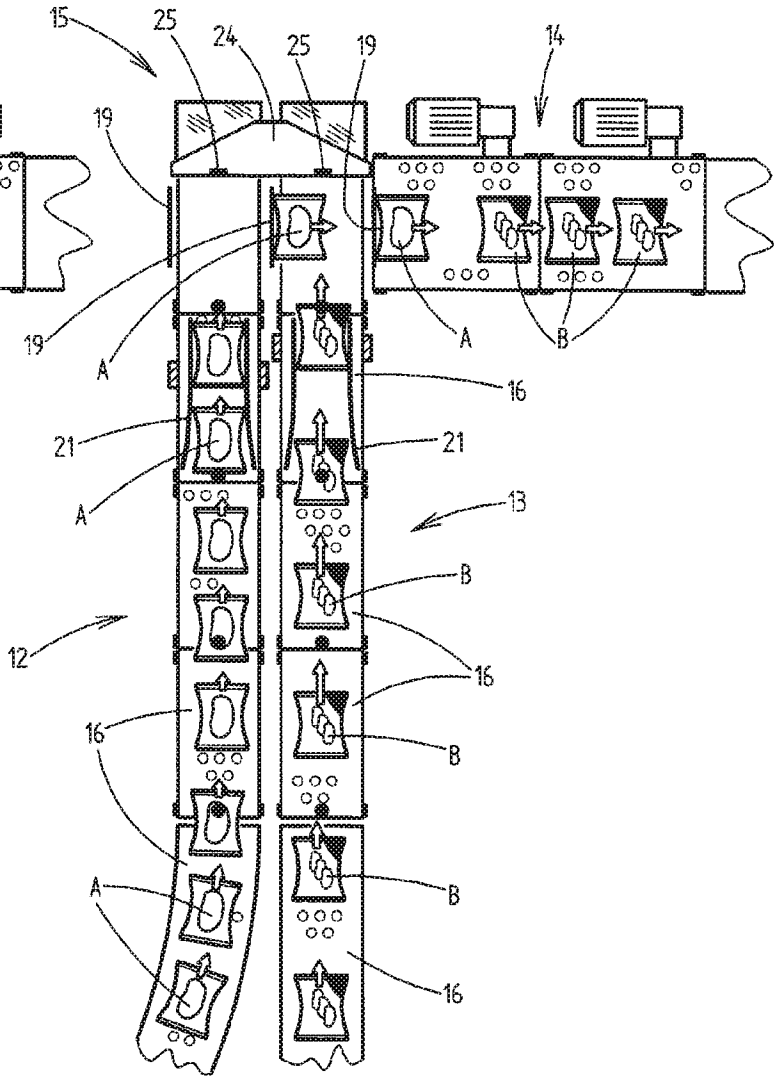

FIGS. 5 and 6 also show that there are also light barriers 25 for each conveying route provided in the region of the stop 24, in order to detect the presence of products A, B in the region of the conveyor 20.

Figure 7:
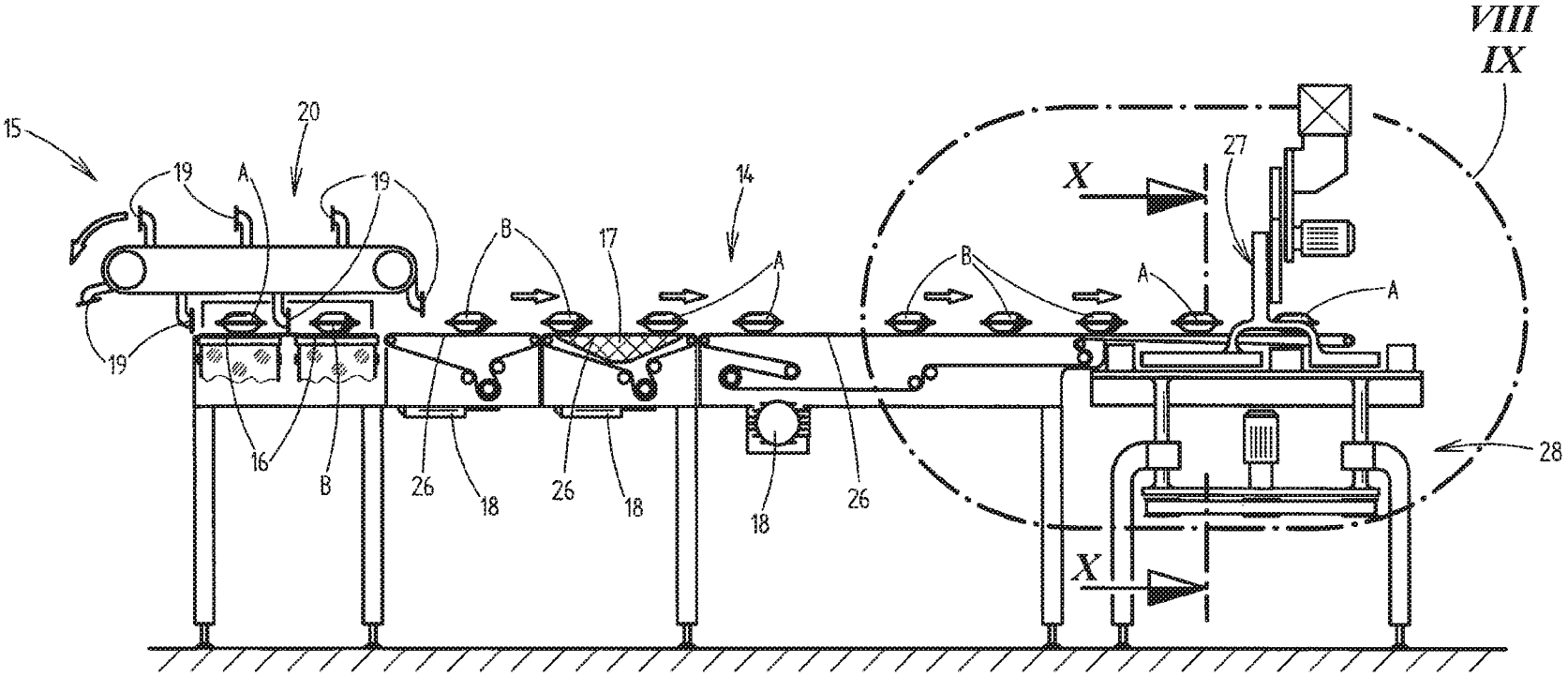
FIG. 7 shows a vertical section through the apparatus according to FIG. 3, taken along section line VII-VII in FIG. 3, FIGS. 8 and 9 show a detail VIII and IX, respectively, of the apparatus according to FIG. 7.
Figure 8:
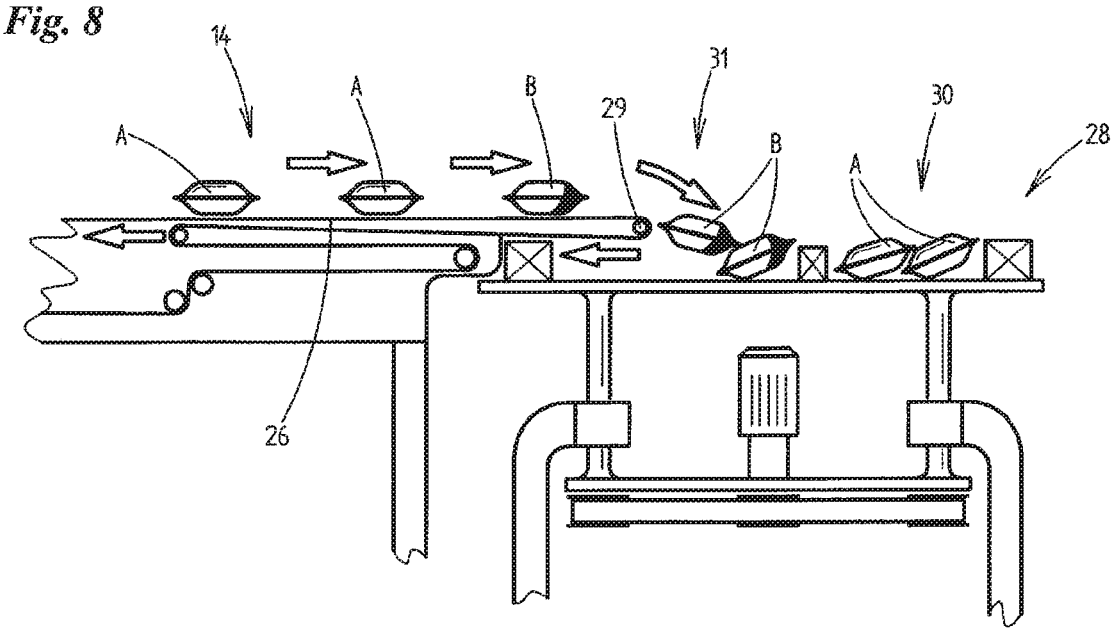

FIG. 7 shows the continued transporting path of the products A, B on the removal conveyor 14. It can be seen here that it is also the case that the removal conveyor 14 is formed from a plurality of conveyor belts 26, which in turn can be driven individually by servomotors 18. The aim of this measure is to form groups of products A, B, wherein the groups, in the present case, correspond in each case to a row or layer of products A, B in the carton 11. This is done here preferably such that the central conveyor belt 26 of the removal conveyor 14 serves to accelerate the products A, B, in order to generate a distance between successive groups. For this purpose, the corresponding conveyor belt 26 is configured with a vacuum chamber 17.

At the end of the removal conveyor 14, the products A, B are pushed off transversely with the aid of a corresponding pusher 27. The pusher interacts with a special transfer table 28, which is of height-adjustable design.

The products A, B are transferred from the removal conveyor 14 to the transfer table 28. For this purpose, the final conveyor belt 26, as seen in the conveying direction, extends into the region of the transfer table 28. A peripheral deflecting roller 29 is mounted in a horizontally displaceable manner in order for it thus to be possible to fill individual compartments 30, 31 of the transfer table 28. In the present case, the compartments 30, 31 are of different sizes or widths, corresponding to the number of products A, B in a group. First of all the compartment 30 is filled with two products A, and then the deflecting roller 29 is drawn back, in order for it to be possible to deposit the products B in the compartment 31. The products A, B are set down by the conveyor belt 26 here, while the deflecting roller 29 is being drawn back, in imbricated formation.

Figure 9:
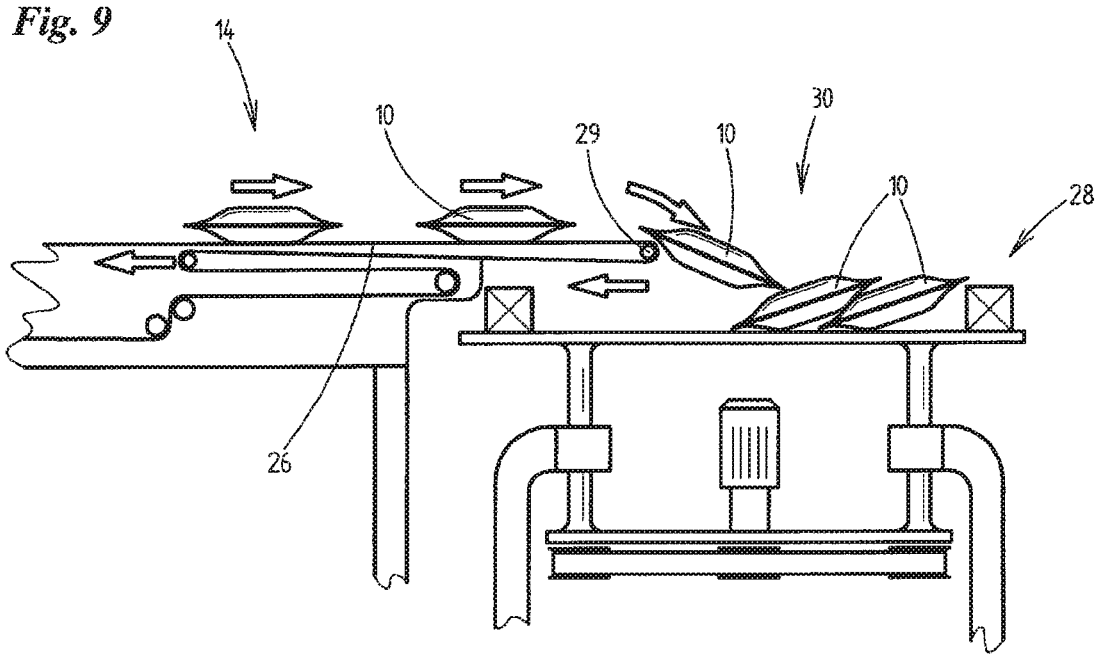

FIG. 9 shows a variant of the transfer table 28 with just one compartment 30. Such a solution can be used if only one type of product is to be fed into the cartons 11.

Figure 10:
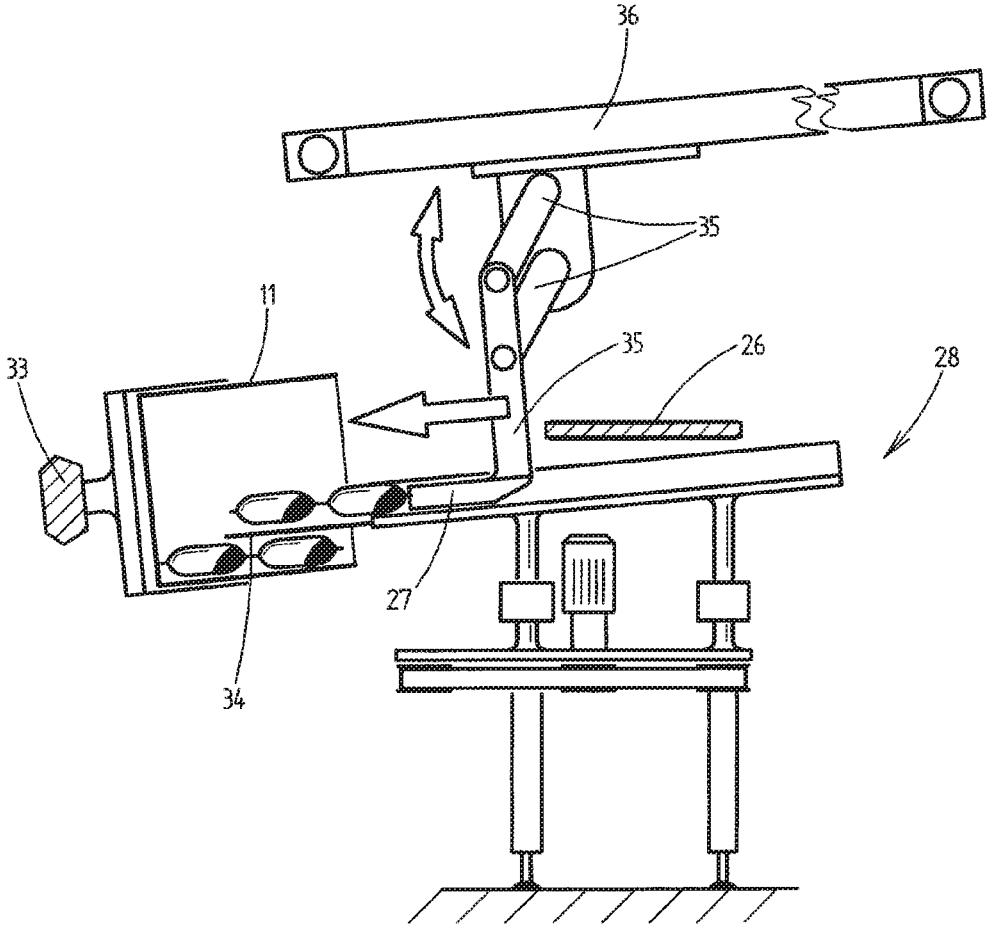
FIG. 10 shows a side view of part of the apparatus in accordance with arrow X in FIG. 7, FIGS. 11 and 12 show a plan view of the apparatus, in the region XI and XII, respectively, according to FIG. 3, during successive phases of the operation of transporting the products.

FIG. 10 shows how the pusher 27 operates. The pusher 27 is maneuvered over the transfer table 28, which is arranged in a slightly inclined manner here, and therefore the products A, B are pushed out of the compartments 30, 31 into a carton 11 supplied. The carton 11 is supplied by a robot 32 or a gripping arm 33 of the same. As the products A, B are being transferred from the transfer table 28, use is made, in addition, of a retractable and extendable guide plate 34, which is already known from similar apparatuses.

The pusher 27 is mounted on a servo spindle 36 via a plurality of levers 35, so as to ensure that the products A, B are pushed off.

Figure 11:
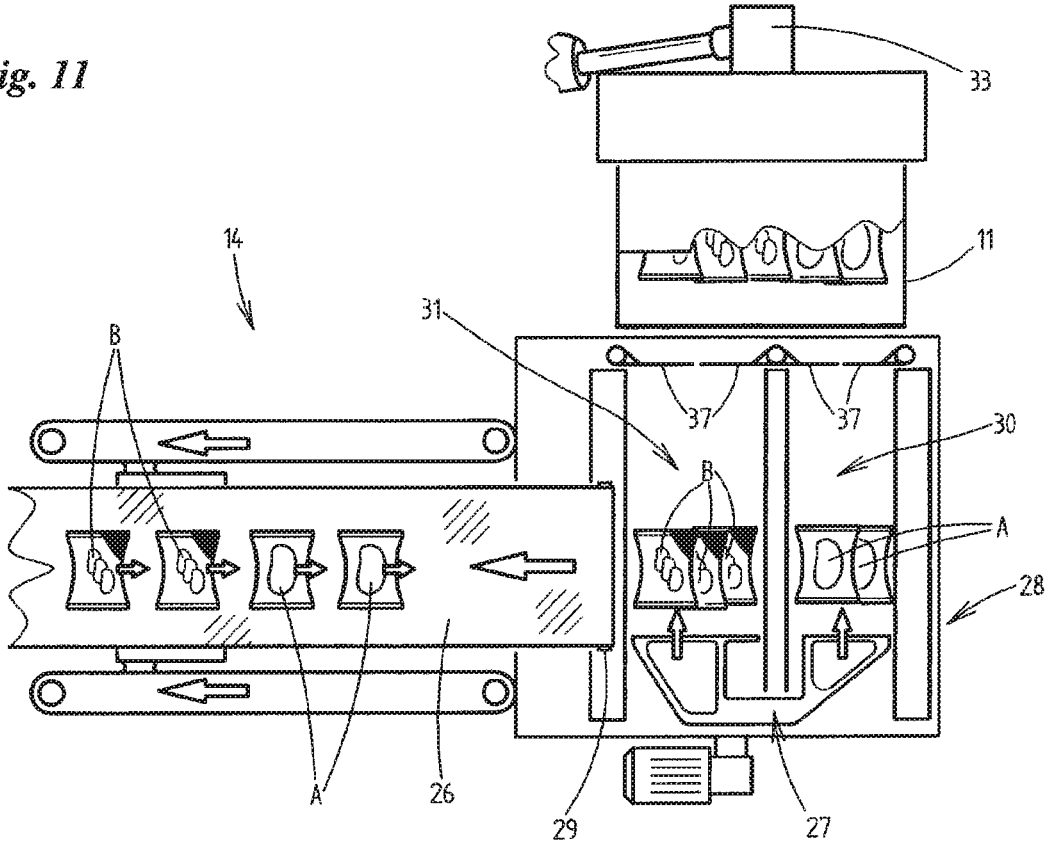
Figure 12:
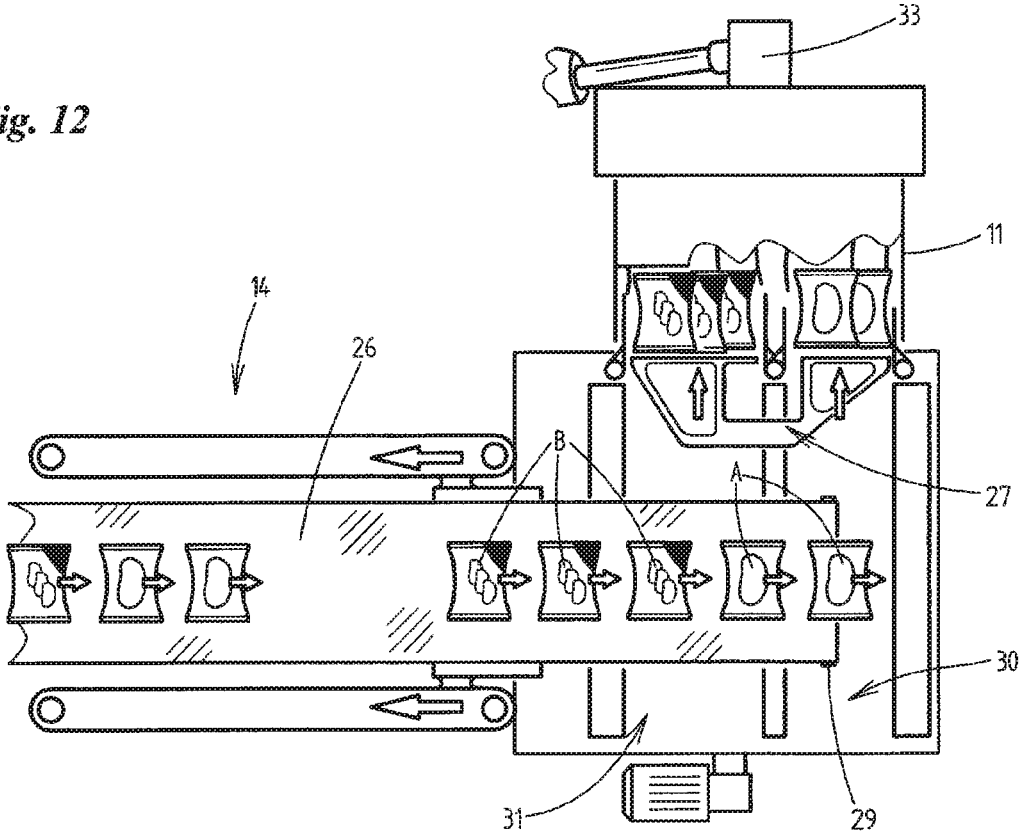

A further detail resides in the fact that the compartments 30, 31 can be closed by shutters 37 on the side oriented toward the carton 11 (FIGS. 11 and 12). This can prevent the situation where products A, B slide undesirably from the transfer table 28 or out of the compartments 30, 31.

The actual operation of feeding the products A, B into a carton 11 functions as follows:

The products A, B are fed on the removal conveyor 14, wherein individually drivable conveyor belts 26 form groups of products A, B each corresponding to a layer or row of products A, B in the carton 11. These groups are then transported from the final conveyor belt 26 to the transfer table 28 and set down there in one of the two compartments 30, 31. During the setting-down operation, the deflecting roller 29 is drawn back, to allow the products A, B to be set down in the compartments 30, 31 from above. Thereafter, the pusher 27 pushes off the products A, B into the carton 11 supplied. For this purpose, the shutters 37 are opened, as shown in FIG. 12.

Following movement of the transfer table 28 and carton 11 relative to one another in the vertical direction, the next row or layer of products A, B can be introduced into the carton 11.

The filled cartons 11 are made ready for being transported away by the robot 32 (FIG. 3). In the present case, there are two robots 32 provided, each handling a carton 11 alternately. The empty cartons 11 are fed by means of a feed conveyor 38.

Figure 13:
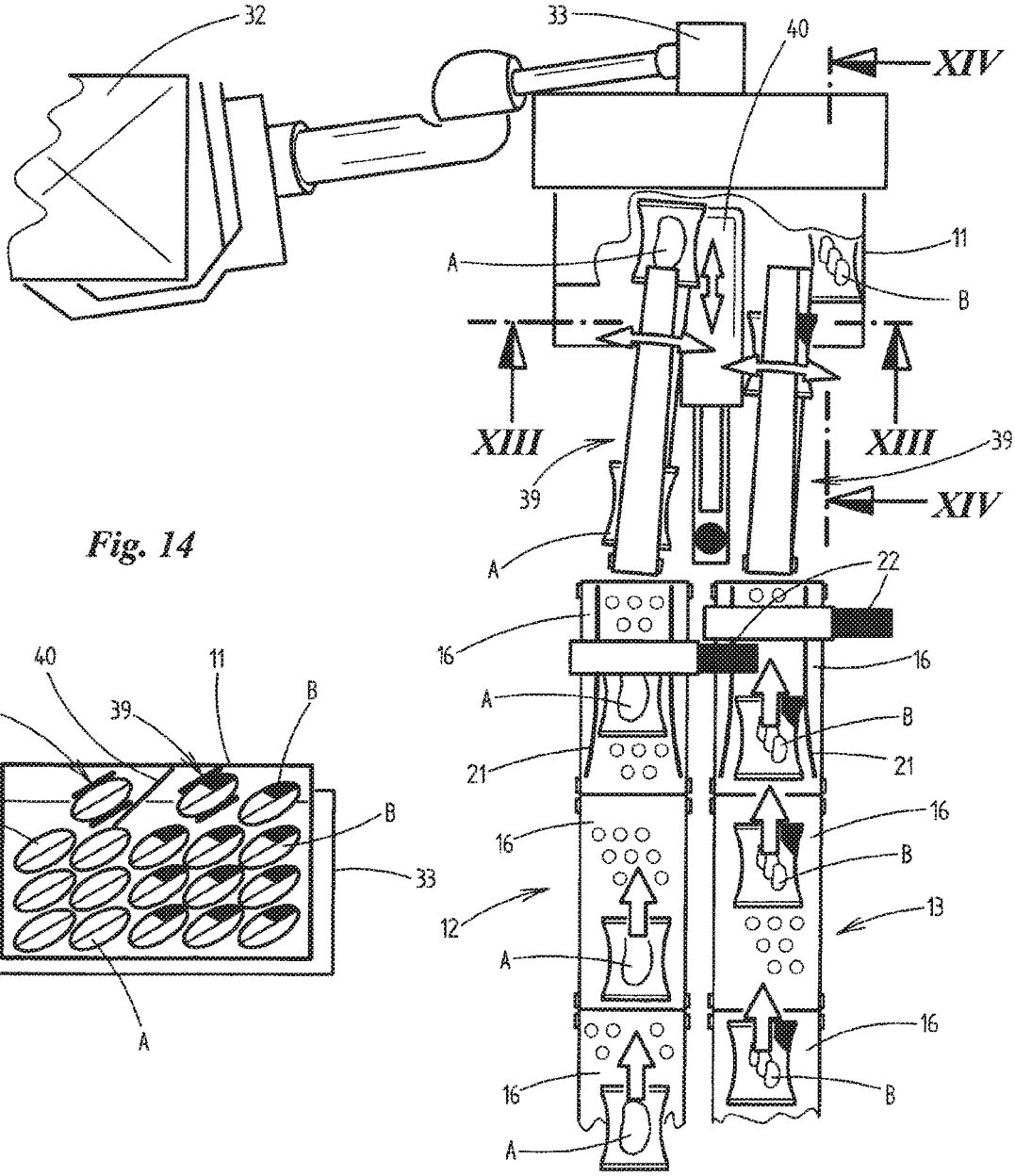
FIG. 13 shows a plan view of a second variant of an apparatus for feeding products into containers.
Figure 14:
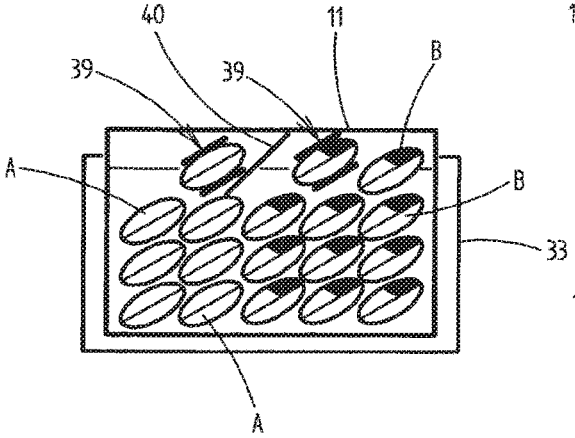
FIG. 14 shows a vertical section through the apparatus according to FIG. 13, taken along section line XIV-XIV.
Figure 15:
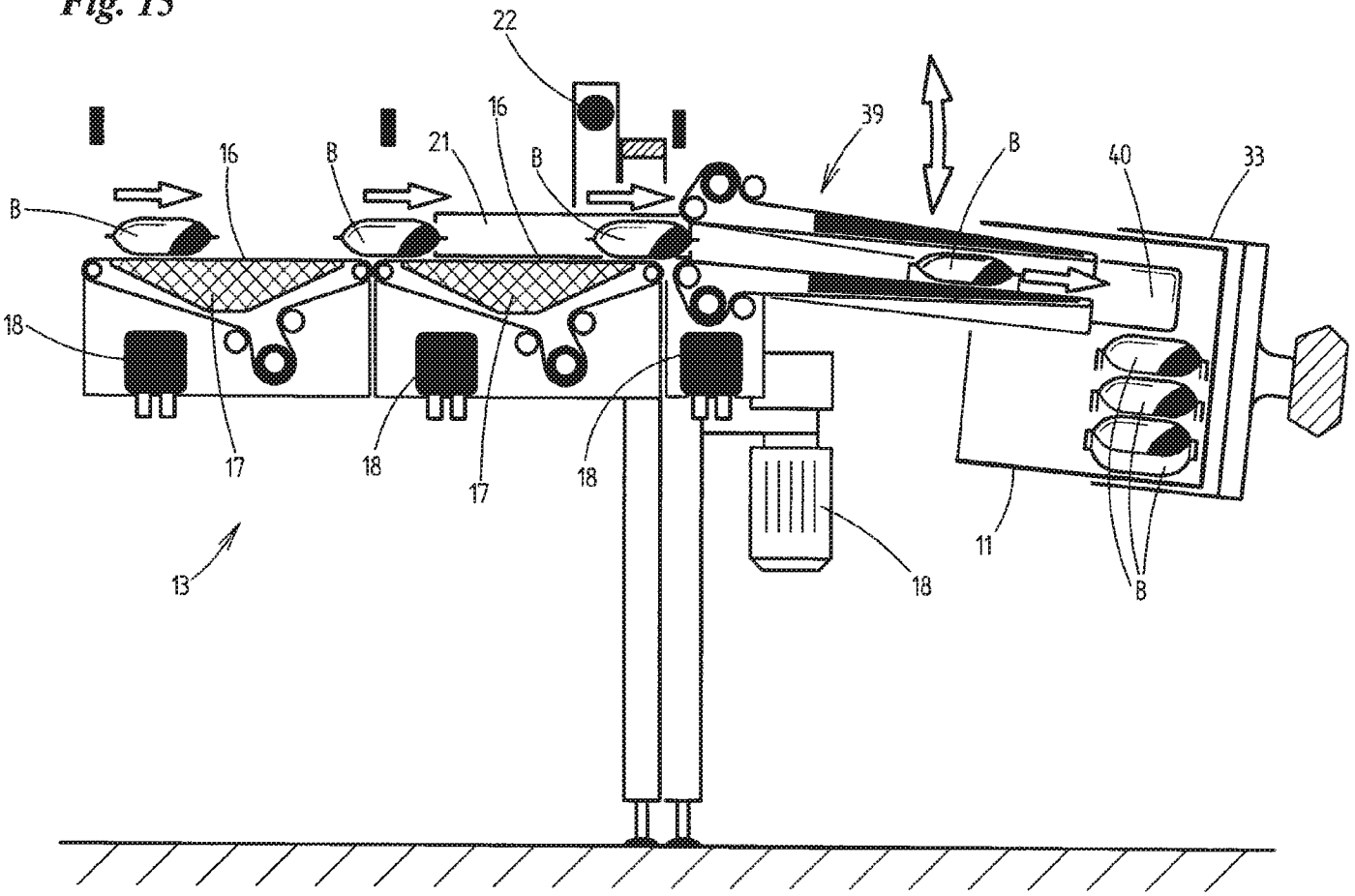
FIG. 15 shows a vertical section through the apparatus according to FIG. 13, taken along section line XV-XV.

A second variant of an apparatus for feeding products into containers is shown in FIGS. 13 to 15. In contrast to the first exemplary embodiment, the products A, B, rather than being transferred from the feeding devices 12, 13 to a transversely directed removal conveyor 14, are transported more or less directly into the cartons 11.

In the present case, this is achieved such that, following the conveyor belts 16, the feeding devices 12, 13 are designed for pivoting action by way of the guide plates 21. In this way, the products A, B, as a result of the feed conveyors 12, 13 being pivoted individually, can be set down in accordance with the desired formation of the products A, B in the container or carton 11.

A special feature also resides in the fact that, in the region of this final conveying portion, the products A, B, rather than resting on a conveyor, are retained between two conveying strands. Against this background, the final conveying portion of the feeding devices 12, 13 will be referred to hereinbelow as set-down conveyor 39. The two set-down conveyors 39 can therefore be pivoted and driven individually. In addition, the conveying strands of the set-down conveyors 39 are designed to be twisted along their longitudinal axis, and therefore the bags 10 can be set down in imbricated formation in the carton 11.

Furthermore, a separator 40 can be moved into the carton in order to separate the products A and B from one another. In particular this makes it possible for first of all the products A, B of one type, and then all the products of another type, to be conveyed into the container.

So that it is possible, in this solution, for the products A, B to be arranged not just in one layer or row in the carton 11, but also in a number of layers or rows arranged one above the other, provision is also made for the set-down conveyors 39 to be capable of being pivoted not just in a horizontal plane, but also in a vertical plane.

It is also the case in the second exemplary embodiment that individual control of the conveying speed of the conveyor belts 16 makes it possible, in the region of the feeding devices 12, 13, to control the order in which the products A, B enter the carton 11. Furthermore, it is also the case, in this solution, for possibly excess products A, B to be ejected or removed, for example by means of an ejecting belt, which can be arranged between the two set-down conveyors 39 (not shown in the figures).

LIST OF REFERENCE SIGNS

10 Bag
11 Carton
12 Feeding device
13 Feeding device
14 Removal conveyor
15 Transfer station
16 Conveyor belt
17 Vacuum chamber
18 Servomotor
19 Pusher
20 Conveyor
21 Guide plate
22 Adjustment motor
23 Carrying arm
24 Stop
25 Light barrier
26 Conveyor belt
27 Pusher
28 Transfer table
29 Deflecting roller
30 Compartment
31 Compartment
32 Robot
33 Gripping arm
34 Guide plate
35 Lever
36 Servo spindle
37 Shutter
38 Feed conveyor
39 Set-down conveyor
40 Separator
A Product
B Product

What is claimed is:

1. A method of feeding products into containers, wherein at least two different types of products are fed into a container, comprising:

a) on feeding devices comprising a plurality of conveyor belts following one after the other in a conveying direction of the products, retaining the products on the conveyor belts by negative pressure created by a vacuum chamber located beneath the conveyor belts;

b) transporting the products via the feeding devices in the direction of a device for feeding the products into a container, wherein each type of the products is transported separately by means of a dedicated one of the feeding devices;

c) controlling the conveying speed of the feeding devices, whereby the products are presented to a removal conveyor in a sequence which corresponds to a desired arrangement of the products within the container;

d) from a final conveyor belt of the conveyor belts of the feeding devices, feeding the products to the removal conveyor, wherein the products are transferred from the each of the feeding devices to the removal conveyor, specifically in accordance with the sequence which corresponds to the desired arrangement of the products within the container, wherein the removal conveyor is formed from a plurality of adjoining conveyor belts on which the products are transported, wherein the removal conveyor is arranged at an essentially equal height level with the final conveyor belt, and wherein the removal conveyor is directed transversely to the feeding devices and correspondingly transports the products away in the direction of the device for feeding the products into the container; and e) using a pusher, pushing the products into the container in the sequence which corresponds to the desired arrangement of the products within the container, wherein the conveying speed of each of the conveyor belts of the feeding devices is controlled individually by a control means whereby the products reach the removal conveyor in the sequence which corresponds to the desired arrangement of the products within the container, wherein the conveying speed of at least one of the conveyor belts of the removal conveyor is controlled by the control means such that groups of products are formed, and wherein distances formed between the groups of products in the conveying direction are greater than those between the products within a group, and wherein the products within a group form a layer or row of products within the container.

2. The method as claimed in claim 1, further comprising removing excess products from the removal conveyor by pushing the excess products off of the removal conveyor in a region where the products are fed to the removal conveyor.

3. The method as claimed in claim 2, wherein the excess products are removed from the removal conveyor by a continuation of the conveying movement of the respective feeding device.

4. The method as claimed in claim 1, further comprising feeding the products into the container directly by the feeding devices, wherein the feeding devices, at least in part, are of pivotable design in order to set down the products at an appropriate location in the container.

5. An apparatus for feeding products into containers, wherein at least two different types of products are fed into a container, comprising:

a) feeding devices for a respective type of products, for transporting the products in the direction of a device for feeding the products into a container, wherein the feeding devices comprise a plurality of conveyor belts on which the products are transported;

b) a vacuum chamber located beneath the conveyor belts for retaining the products on the conveyor belts by negative pressure created by the vacuum chamber;

c) a removal conveyor to which the products are fed by the feeding devices, wherein the products are arranged on the removal conveyor in accordance with a sequence which corresponds to a desired arrangement of the products in the container, wherein the removal conveyor is directed transversely to the feeding devices and transports the products in the direction of the device for feeding the products into the container, and wherein the removal conveyor is formed from a plurality of adjoining conveyor belts on which the products are transported;

d) a control means for controlling the conveying speed of the conveyor belts of the feeding devices for presenting the products to the removal in the desired sequence which corresponds to the arrangement of the products within the container, wherein the conveying speed of the conveyor belts is influenced by the control means such that the products reach the removal conveyor in a sequence which corresponds to the desired arrangement of the products in the container;

e) a pusher for pushing the products into the container in the sequence which corresponds to the desired arrangement of the products within the container, wherein the conveying speed of each of the conveyor belts of the feeding devices is controlled individually by the control means, whereby the products are fed to the removal conveyor in a desired order of the products on the removal conveyor;

wherein at least a final conveyor belt of the conveyor belts of the feeding devices and the removal conveyor are arranged at an essentially equal height level, and therefore the products are pushed off of the conveyor belts using the pusher onto the removal conveyor, wherein the conveying speed of at least one of the conveyor belts of the removal conveyor is controlled by the control means such that groups of products are formed, and wherein distances formed between the groups of products in the conveying direction are greater than those between the products within a group, and wherein the products within a group form a layer or row of products within the container.

6. The apparatus as claimed in claim 5, wherein the feeding devices, at least in part, are of pivotable design in order to set down the products directly in the container at the appropriate position.

7. The apparatus as claimed in claim 6, wherein the feeding devices are endless conveyors for transferring the products into the container, wherein the products are retained and transported between conveying strands of the endless conveyors, and wherein planes formed by the conveying strands are pivotable in the transporting direction in order to feed the product to the container in accordance with the position of the product in the container.

8. The apparatus as claimed in claim 7, wherein the feeding devices are pivotable and/or driven independently of one another.

9. The apparatus as claimed in claim 6, wherein the feeding devices are pivotable and/or driven independently of one another.

* * * * *